US010994892B2

(12) United States Patent
Bell et al.

(10) Patent No.: US 10,994,892 B2
(45) Date of Patent: May 4, 2021

(54) FOOD CONTAINER AND METHOD OF USE

(71) Applicant: One Equals Three, LLC, San Marcos, CA (US)

(72) Inventors: Edward Bell, San Marcos, CA (US); Jessica Bell, San Marcos, CA (US)

(73) Assignee: One Equals Three, LLC, San Marcos, CA (US)

( * ) Notice: Subject to any disclaimer, the term of this patent is extended or adjusted under 35 U.S.C. 154(b) by 184 days.

(21) Appl. No.: 16/267,124

(22) Filed: Feb. 4, 2019

(65) Prior Publication Data

US 2019/0375551 A1 Dec. 12, 2019

Related U.S. Application Data

(60) Provisional application No. 62/683,457, filed on Jun. 11, 2018.

(51) Int. Cl.

| | |
|---|---|
| ***B65D 25/06*** | (2006.01) |
| ***B65D 1/22*** | (2006.01) |
| ***B65D 81/32*** | (2006.01) |
| ***B65D 45/24*** | (2006.01) |
| ***B65D 21/02*** | (2006.01) |

(52) U.S. Cl.

CPC ..... *B65D 25/06* (2013.01); *B65D 1/22* (2013.01); *B65D 21/0222* (2013.01); *B65D 45/24* (2013.01); *B65D 81/3216* (2013.01)

(58) Field of Classification Search

CPC .... B65D 25/06; B65D 81/3216; B65D 45/24; B65D 45/16; B65D 45/18; B65D 45/20; B65D 41/14; B65D 41/44; B65D 51/12; B65D 51/185

USPC ..... 220/523, 526, 23.88, 528, 529, 23.87, 220/23.86, 378

See application file for complete search history.

(56) References Cited

U.S. PATENT DOCUMENTS

| | | | | |
|---|---|---|---|---|
| 1,716,367 | A | 6/1929 | Clayton | |
| 2,731,996 | A | 1/1956 | Hayes | |
| 4,991,717 | A * | 2/1991 | May | B65D 43/0206 206/455 |
| 5,462,192 | A | 10/1995 | Pomroy et al. | |
| 8,376,177 | B2 * | 2/2013 | Castner | B65D 43/0218 220/526 |
| 9,051,096 | B2 | 6/2015 | Tuan | |
| 2010/0147846 | A1 * | 6/2010 | Soibel | B65D 43/0233 220/202 |
| 2011/0121002 | A1 * | 5/2011 | Stiller | B65D 21/083 220/504 |

(Continued)

FOREIGN PATENT DOCUMENTS

| | | |
|---|---|---|
| CN | 204682802 U | 10/2015 |
| GB | 2538958 A | 12/2016 |

(Continued)

*Primary Examiner* — Robert Poon

(74) *Attorney, Agent, or Firm* — Procopio Cory Hargreaves and Savitch LLP

(57) ABSTRACT

A versatile food container that uses a sealing layer to cover movable/reconfigurable/removable internal dividing compartments that maintains a leak-proof seal along the perimeter as well as in between the internal compartments. The container has a variety of features and accessories that can be applied, making it effective for storing, cooking and transporting food.

11 Claims, 12 Drawing Sheets

(56) References Cited

U.S. PATENT DOCUMENTS

| | | | | |
|---|---|---|---|---|
| 2014/0346077 | A1* | 11/2014 | Strilich | B65D 81/261 206/499 |
| 2015/0166232 | A1* | 6/2015 | Lee | B65D 81/20 220/315 |
| 2015/0183536 | A1 | 7/2015 | Miros et al. | |
| 2016/0200499 | A1* | 7/2016 | Dhand | B65D 81/3222 220/523 |
| 2019/0112105 | A1* | 4/2019 | Lubbe | B65D 43/0212 |
| 2019/0127127 | A1* | 5/2019 | Aznar | B65D 25/04 |

FOREIGN PATENT DOCUMENTS

| | | | |
|---|---|---|---|
| KR | 200406266 | U | 1/2006 |
| KR | 101156576 | B1 | 6/2012 |

* cited by examiner

FOOD CONTAINER AND METHOD OF USE

CROSS-REFERENCE TO RELATED APPLICATION

This application claims priority to U.S. Provisional Patent Application No. 62/683,457, filed Jun. 11, 2018, under 35 U.S.C. 119, which is incorporated by reference herein.

FIELD OF THE INVENTION

The present invention relates to a food container for storing, cooking and transporting food.

BACKGROUND OF THE INVENTION

A standard food container consists of a base unit to place food into and a lid to secure it. As a way to prevent leakage, the container may use a seal around the rim of the base unit or lid.

The container may use internal compartments as a way to keep different foods separated from each other. These internal compartments are often molded into the base unit, sectioned off using dividing panels, or separate removable inserts. However, leakage between internal compartments is common. Wet foods or juices from foods can seep through spaces along the sides or bottom of diving panels, or over the top of compartment walls.

Some containers seal the tops of the internal compartments by having a sealing layer that might be attached to or be part of the lid. This sealing layer has grooves that line up and receive the tops of the walls from the internal compartments. This method offers no versatility among the internal compartments as they must remain in the same configuration in order to properly seal.

Presently, there is no solution for a sealing layer that provides a perimeter seal, as well as a seal between movable/removable/reconfigurable internal compartments to maintain a leak-proof seal inside and out.

SUMMARY OF THE INVENTION

An aspect of the invention seeks to provide a solution to this problem by using a sealing layer that presses down on any movable/removable/reconfigurable internal compartments no matter of width, length, location or quantity inside the base unit.

Another aspect of the invention involves a food container comprising a base unit including an open top and a base unit rim defining a periphery of the open top; one or more removable internal compartments disposed within the base unit, the one or more removable compartments each including an internal compartment rim; a sealing layer covering the open top and engaging the base unit rim and the internal compartment rim of the one or more removable internal compartments so as to form a leak-proof seal between the base unit rim and the internal compartment rim of the one or more removable internal compartments.

One or more implementations of the aspect of the invention described immediately above includes one or more of the following: the food container includes a lid that goes over the sealing layer and covers the open top of the base unit; the sealing layer and the lid together form a lid assembly; the sealing layer is removably attachable to the lid; the lid includes an underside with an engaging groove and the sealing layer includes a lip that is removably insertable within the engaging groove to removably attach the sealing layer to the lid; the food container includes a lid guide that extends laterally outward and upward from the open top of the base unit and guides the lid onto the base unit so that the sealing layer forms the leak-proof seal between the base unit rim and the internal compartment rim of the one or more removable internal compartments; the lid extends over and laterally outward from the base unit rim, onto the lid guide; the sealing layer covers the base unit rim, under the lip; the sealing layer is flexible and includes one or more features to add strength and stability to the sealing layer; the one or more features to add strength and stability to the sealing layer include one or more of rod-shaped features and hexagon-shaped features; the food container includes a removable ring assembly that fits over a bottom of the base unit; the removable ring assembly includes a ring that surrounds the base unit and abuts the base unit rim to prevent the removable ring assembly from sliding over a top of the base unit; the food container includes a lid that goes over the sealing layer and covers the open top of the base unit, and the removable ring assembly includes a ring clamp operable to secure the lid and the sealing layer to the open top of the base unit; the removable ring assembly includes a ring engaging groove and the base unit includes a base unit interference nodule that the ring engaging groove catches on to avoid accidental slipping of the ring assembly relative to the base unit when the ring clamp is not engaged; the lid and the sealing layer form a lid assembly having a height when not engaged with the open top of the base unit that is greater than a height between a top of the lid and a bottom of the sealing layer where the sealing layer engages the base unit rim and the internal compartment rim of the one or more removable internal compartments when the lid assembly is engaged with the open top of the base unit; the base unit includes side walls with an angled base bevel along a bottom of the base unit, and the one or more removable internal compartments includes an internal compartment bevel, ensuring that when the one or more removable internal compartments are disposed in the base unit, the one or more removable internal compartments are positioned away from the side walls of the base unit so that the leak-proof seal is formed between the base unit rim and the internal compartment rim of the one or more removable internal compartments; the base unit and the internal compartments are made of a food-grade stainless steel; the base unit is configured to be nestable within another base unit and the one or more removable internal compartments include multiple removable internal compartments configured to be nestable within each other; and/or the food container includes a lid assembly including a lid and the sealing layer, and the base unit and the lid are configured so that the base unit can rest on the lid, providing a more secure base unit while eating, while also taking up less space, and allowing the food container to stack on top of another food container with the lid intact.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1:
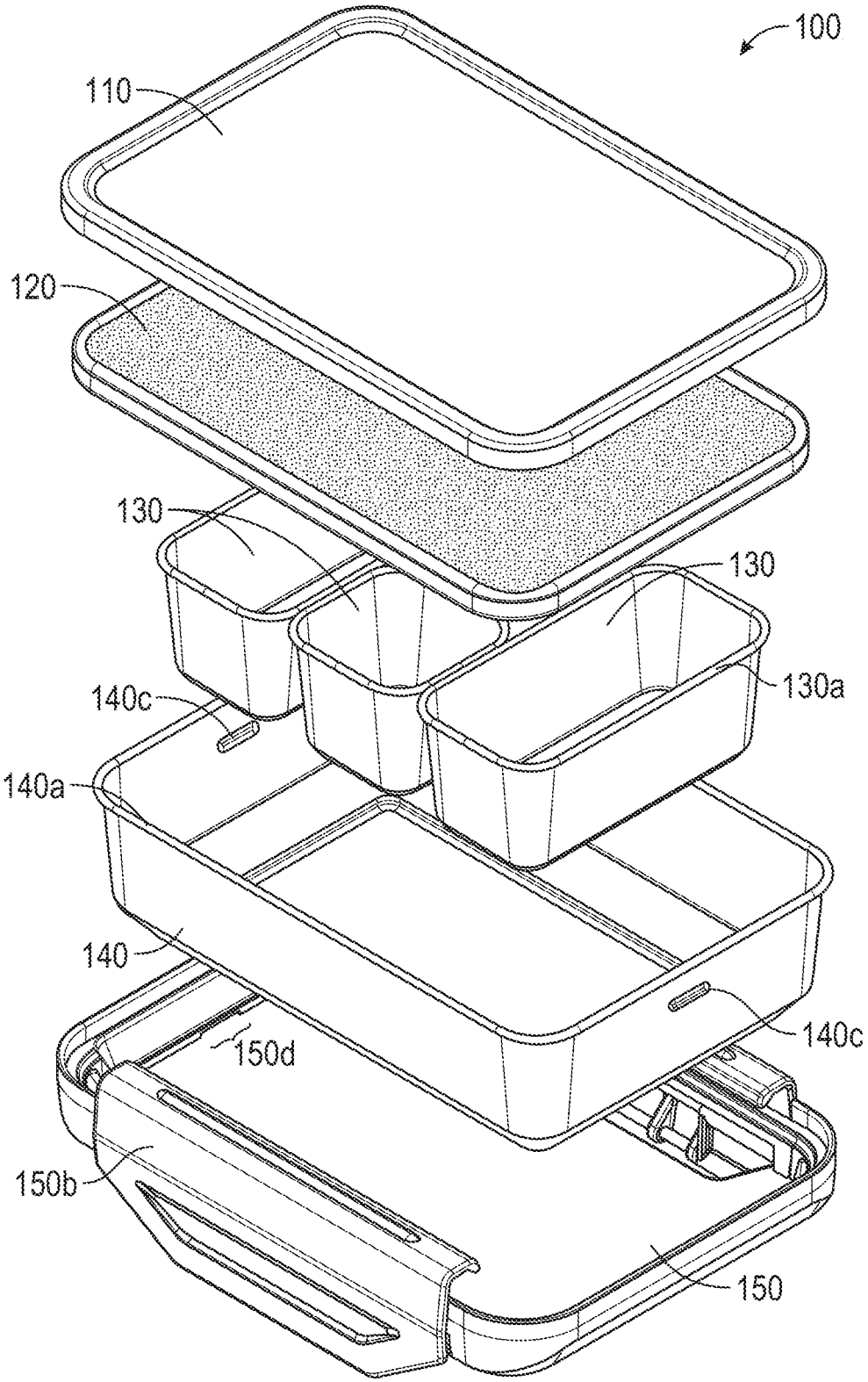
FIG. 1 is an exploded perspective view of an embodiment of the container showing many of the core components.
Figure 2A:
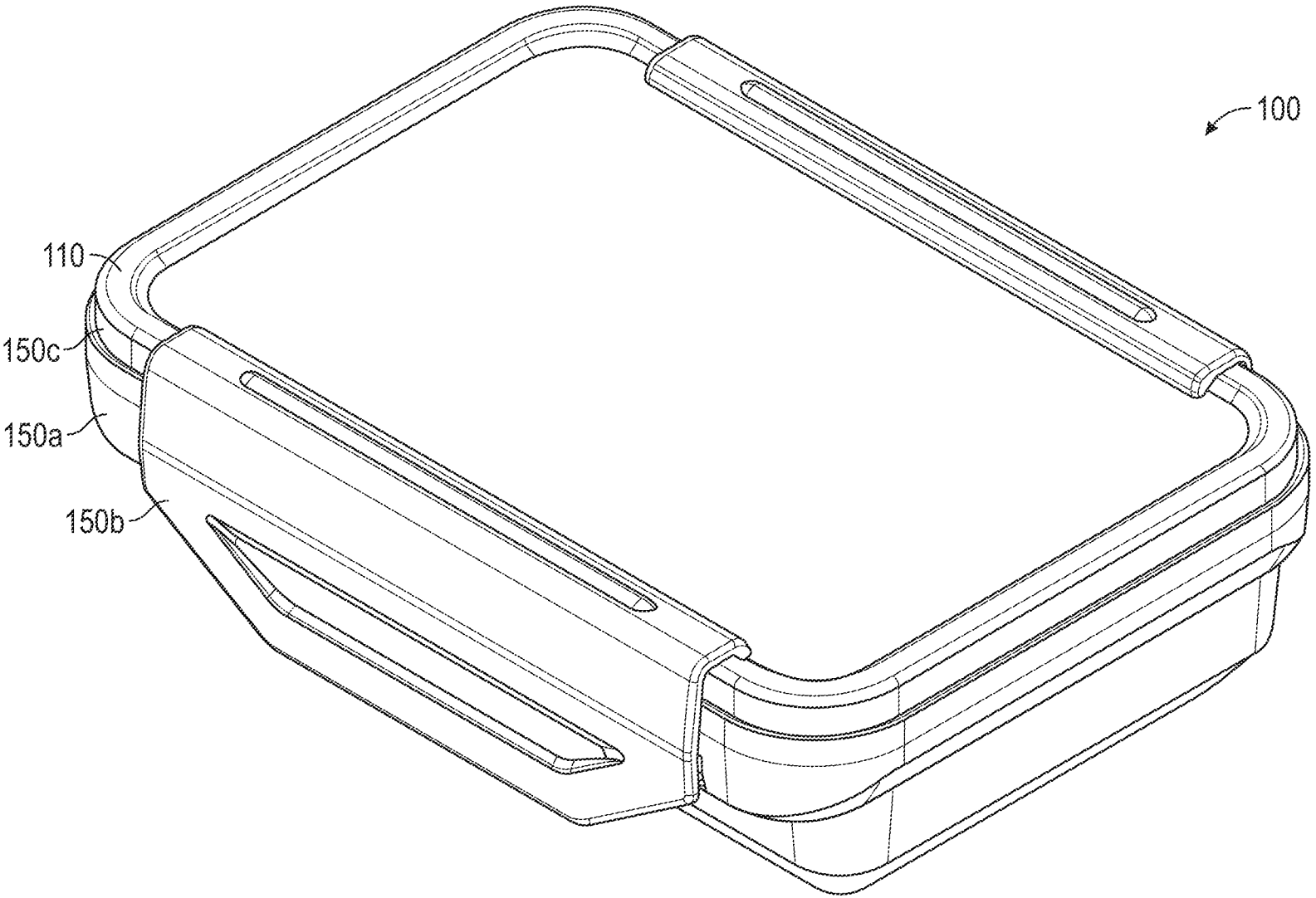
FIG. 2A is a perspective view of the container showing the ring assembly engaged.
Figure 2B:
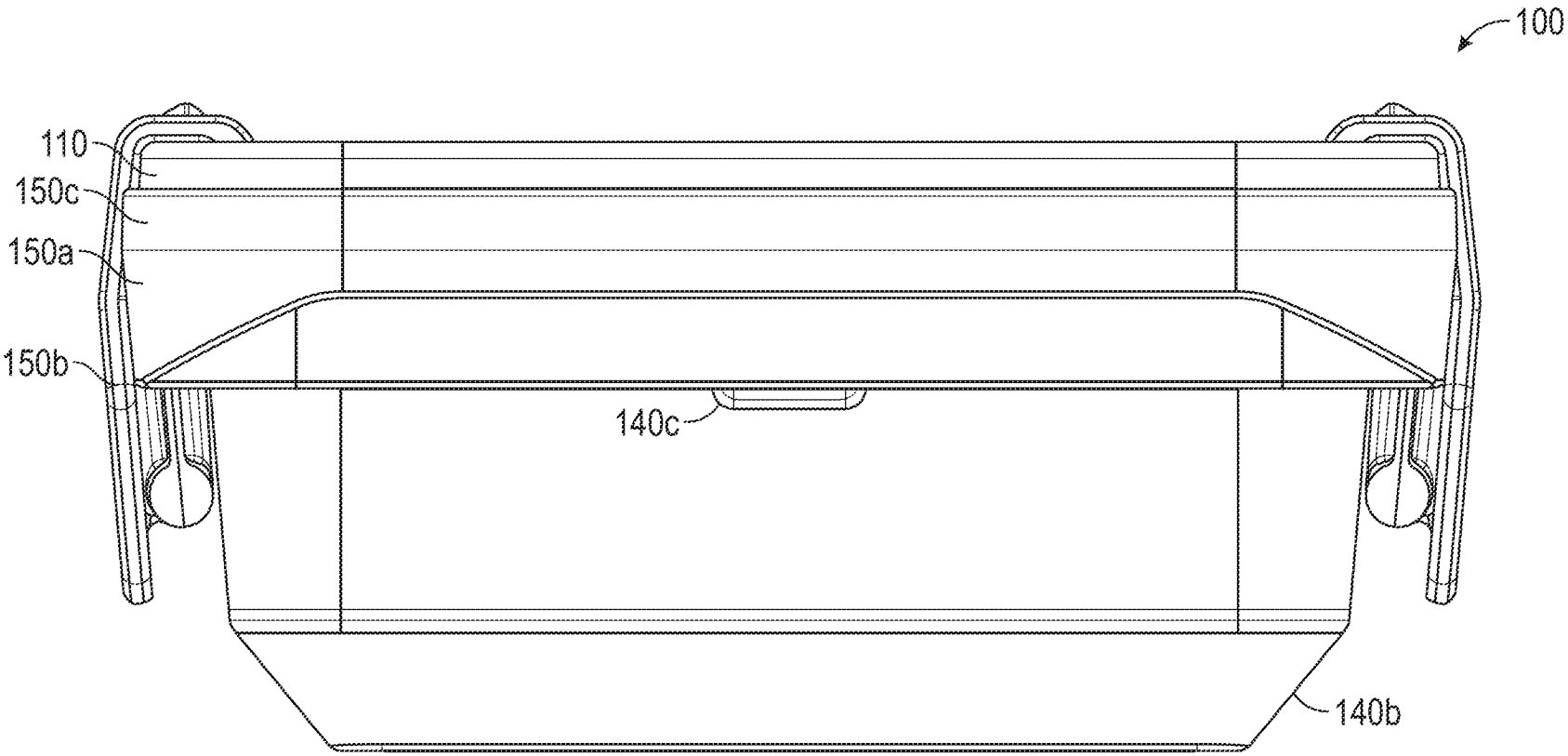
FIG. 2B is a side view of the container showing the same engaged ring assembly as shown in FIG. 2A.
Figure 3:
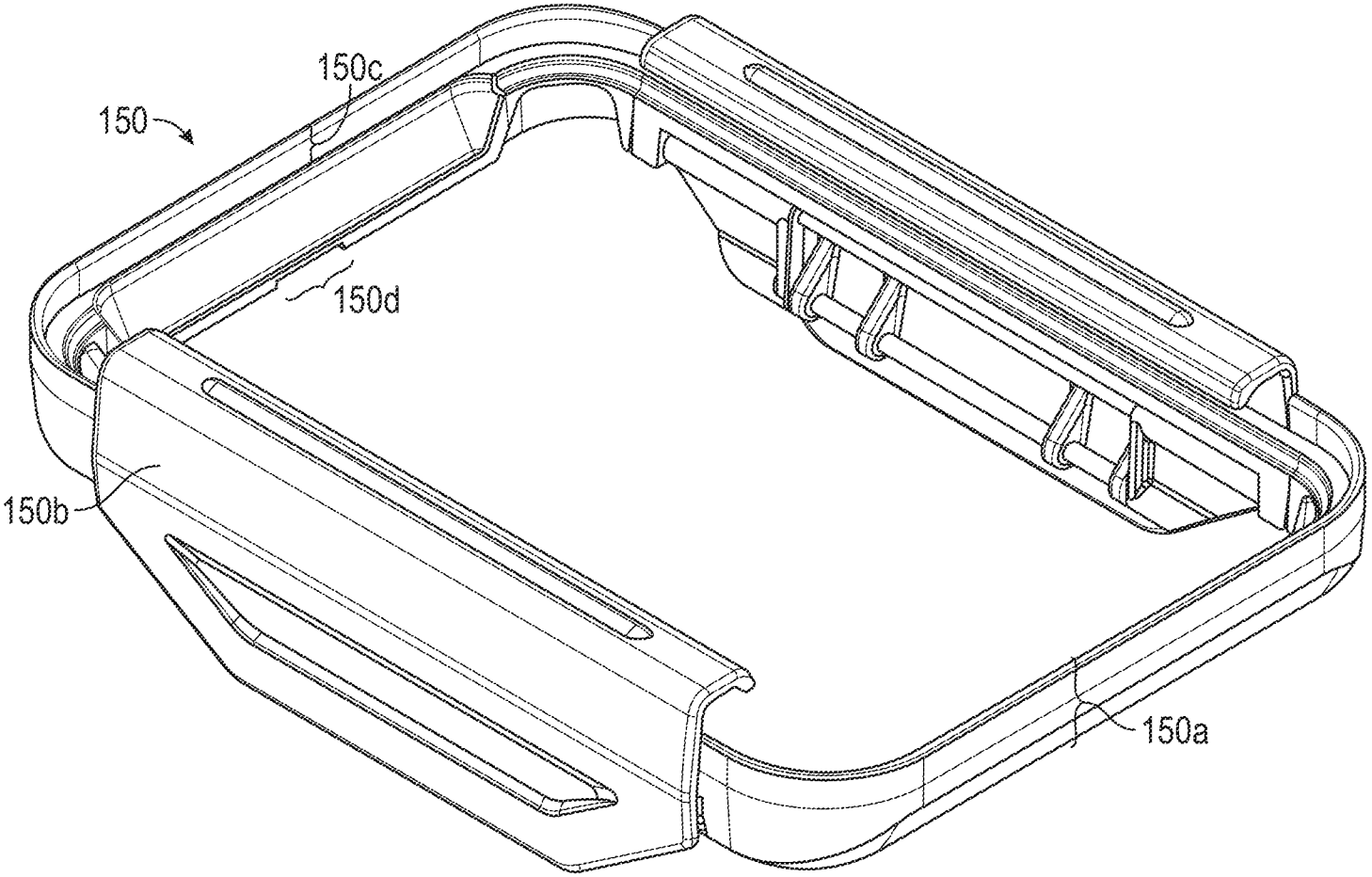
FIG. 3 is a perspective view of the ring assembly.
Figure 4:
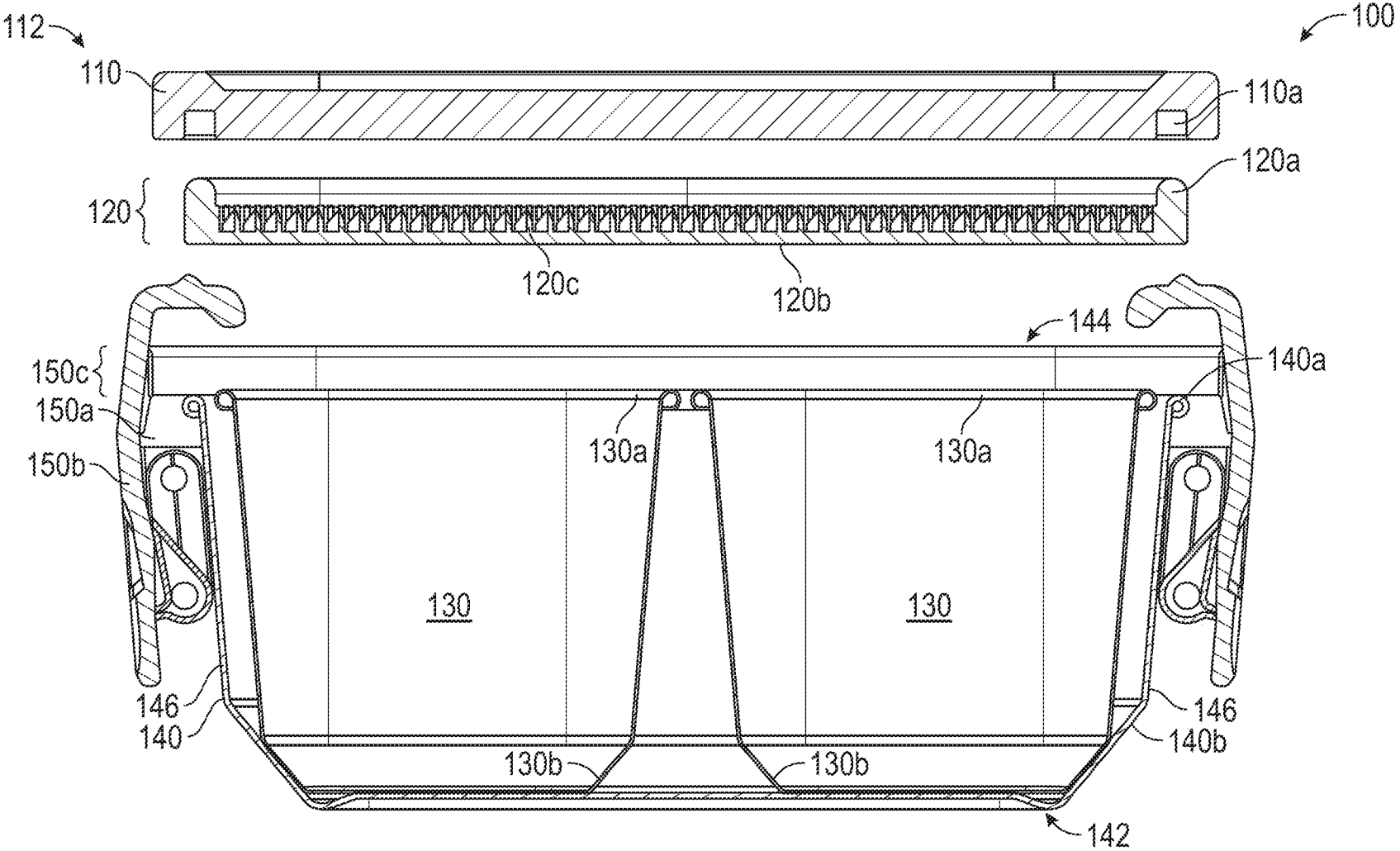
FIG. 4 is a cross-sectional side view with the lid and sealing layer exploded and separated from each other.
Figure 5:
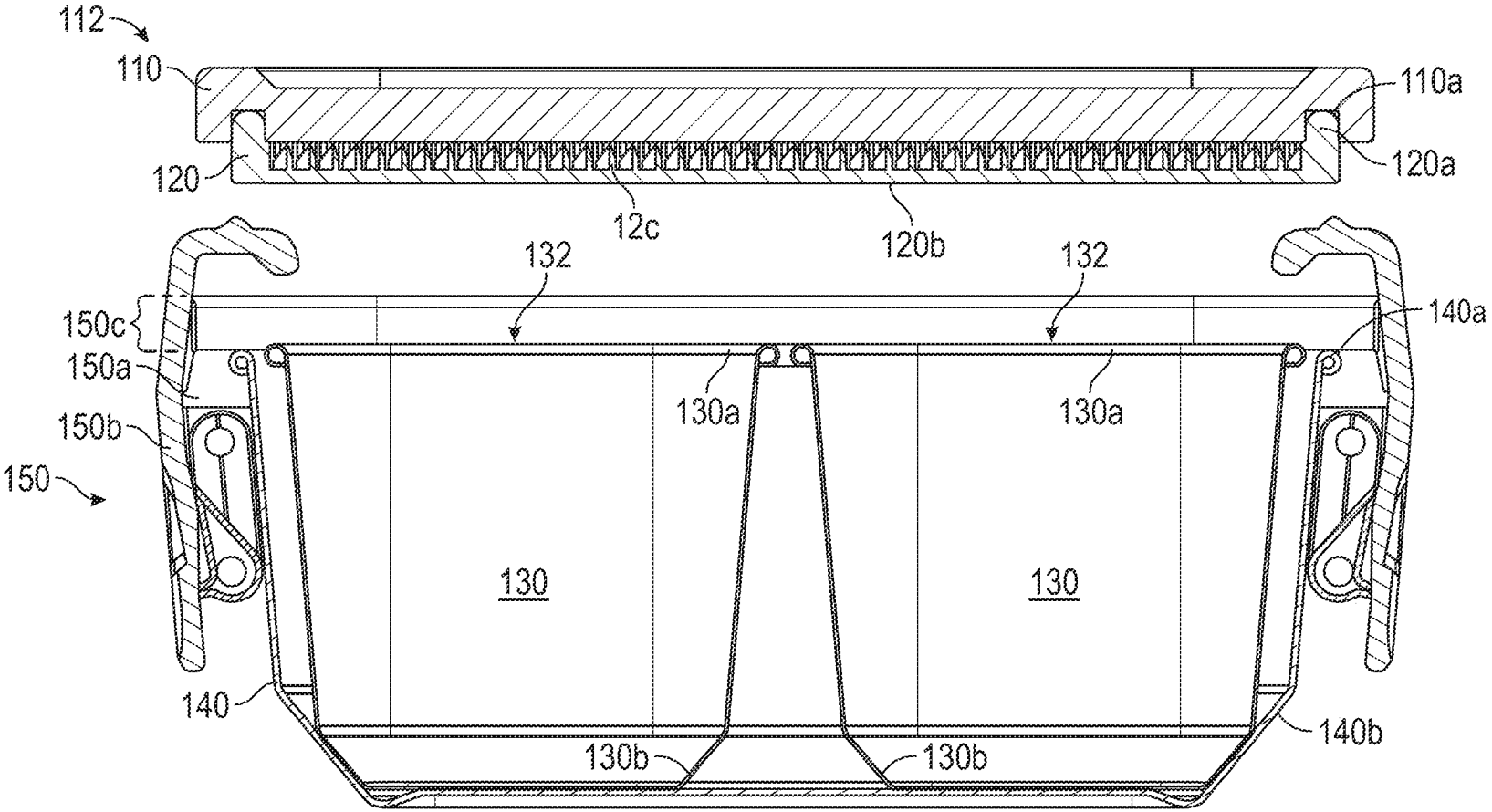
FIG. 5 is a cross-sectional view similar to FIG. 4, but showing the seal engaged to the lid.
Figure 6:
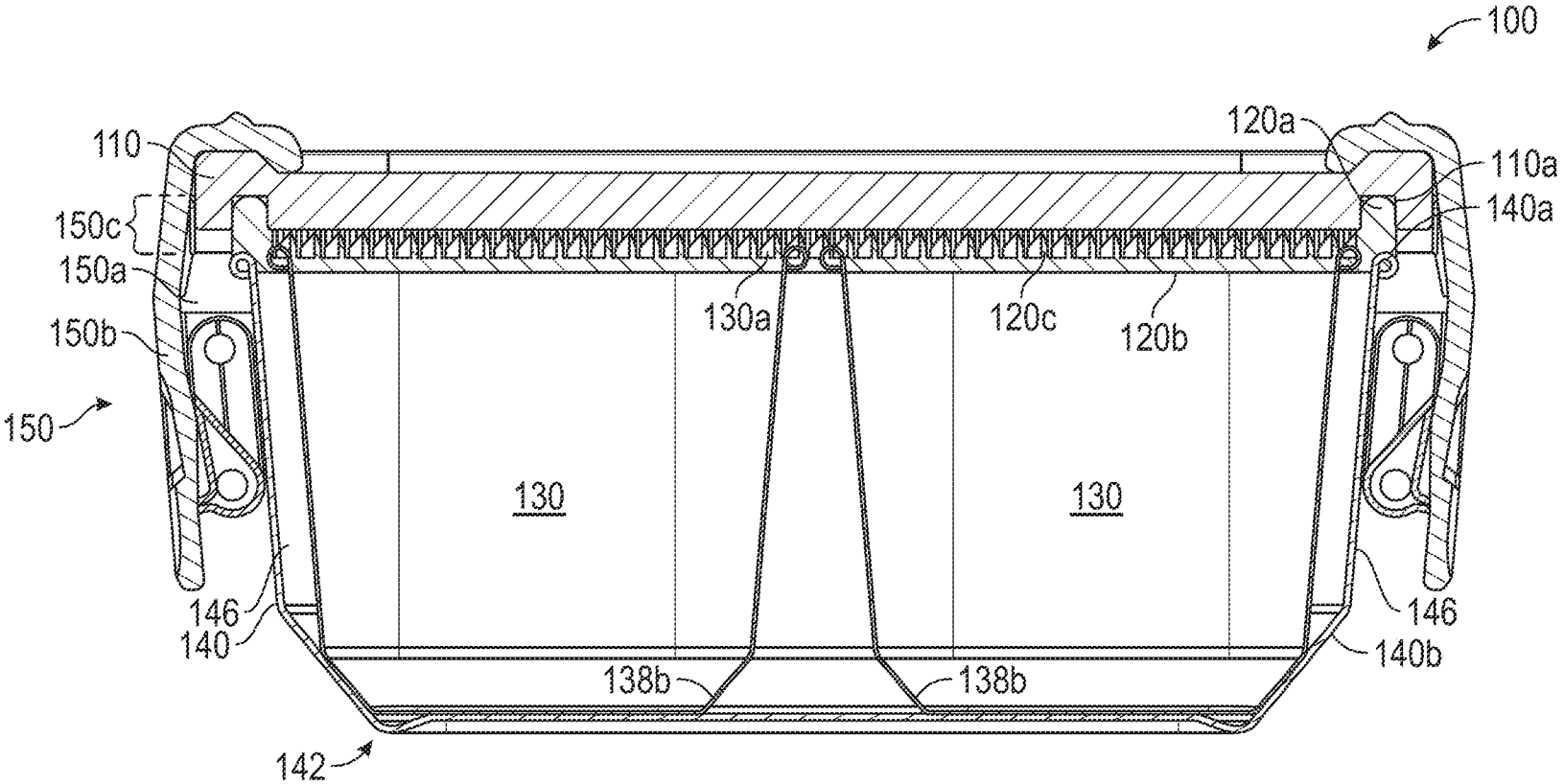
FIG. 6 is a cross-sectional view showing the lid with seal secured into place on the base unit.

With reference to FIGS. 1-11, and initially primarily to FIG. 1, the main components of an embodiment of a food container 100 of the present invention, showing an order of assembly, are shown and will be described. A sealing layer 120 connects to and covers the bottom of a lid 110. Internal compartments 130 fit within a base unit 140 and can be rearranged as needed. The lid 110 with sealing layer 120 engaged (shown in FIG. 5) is placed on to the base unit 140, covering a base unit rim 140*a* as well as internal compartment rims 130*a* (FIG. 6). A ring assembly 150 slips onto the base unit 140 from the bottom and stops at the hem of the base unit rim 140*a* while a ring engaging groove 150*d* (shown in FIG. 1) catches on a base unit interference nodule 140*c* to avoid accidental slipping of the ring assembly 150 when not engaged. A ring clamp 150*b* can then be engaged to securely fasten the lid 110 containing the sealing layer 120 to the base unit 140.

Figures 8A, 8B, 8C:
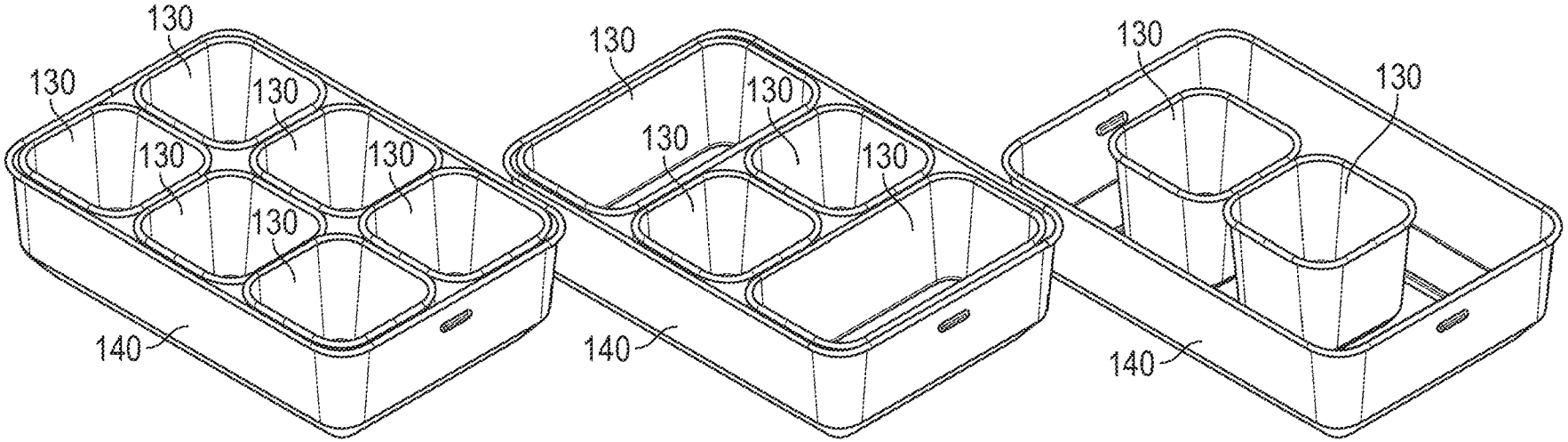
FIG. 8A is a perspective view showing a base unit filled with internal compartments of the same size and shape.
FIG. 8B is an perspective similar to FIG. 8A, but showing internal compartments with a different set of sizes and shapes.
FIG. 8C is an perspective view showing internal compartments moved and removed from the base unit.

The base unit 140 may contain internal compartments 130 that are of different shapes or sizes of lengths and widths and can be removed and/or arranged in an array of different configurations and locations within the base unit 140. A small sample set of different configurations is illustrated in FIG. 8A, FIG. 8B and FIG. 8C.

In an exemplary method of using the food container, when preparing food and/or beverages to be stored/transported in the container or after using the food container (e.g., after eating), one or more internal compartments 130 of the same and/or different configurations are arranged in the base unit 140 in any desired position(s) as long as open end 132 (FIG. 5) is facing upward in base unit 140 and the lid 110 with sealing layer 120 is secured to the base unit 140 (with the ring clamp 150*b* securely fastening the lid 110) as shown in FIG. 6 so that a perimeter seal, as well as a seal between movable/removable/reconfigurable internal compartments 130, is provided to maintain a leak-proof seal inside and out. When ready to eat, remove one or more internal compartments 130, and/or clean the one or more internal compartments 130, the ring clamp 150*b* is unfastened from the lid 110 and the lid 110 with sealing layer 120 is removed from the base unit 140. The one or more internal compartments 130 may be accessed (e.g., for eating/drinking the contents, removing one or more internal compartments 130, and/or cleaning the one or more internal compartments 130). When ready to re-use the food container, one or more of the same and/or different internal compartments 130 as those used previously are arranged in the base unit 140 in any desired position(s) and the above process is repeated.

Cross-sectional side views of the food container are shown in FIG. 4, FIG. 5 and FIG. 6, illustrating the separation and connection of the sealing layer 120 to the lid 110, and the securing of a lid assembly 112 (e.g., the lid 110 and connected sealing layer 120) to the base unit 140 with the ring clamp 150*b*.

In reviewing the lid assembly 112 including the sealing layer 120 and the lid 110, FIG. 4 identifies an engaging groove 110*a* along a periphery and underside of the lid 110 and a lip 120*a* of the sealing layer 120. The lip 120*a* fits into the engaging groove 110*a* (FIG. 5). The length and/or width of the sealing layer 120 may be shorter than the distance between the engaging grooves 110*a*. Therefore, the sealing layer 120 may stretch so that the lip 120A fits into the engaging groove 110*a* to provide enough pushing force so that the sealing layer 120 will remain intact with the lid 110 when removing from and inserting into the base unit 140. It should be noted that this pushing force can also be accomplished by other factors (not shown) such as, but not limited to, an interference nodule on the lip 120A that protrudes out to provide enough pushing force when placed into the engaging groove 110*a*. However, the sealing layer 120 can be easily removed from the engaging groove 110*a* by hand for purposes of cleaning.

The cross-sectional view in FIG. 6 illustrates the method of producing a leak-proof seal between internal compartments 130 as well as at the rim 140*a* of the base unit 140.

The base unit 140 may be slightly narrower at a bottom 142 than at its rim 140*a* or top 144, thus allowing for the ring assembly 150 to slide up from the bottom 142 of the base unit 140 and fit securely along sides 146 due to a lateral outward pushing force from the sides 146 of the base unit 140 once the ring assembly 150 reaches its stopping point at the hem of the base unit rim 140*a*. For a more secure fastening, the base unit 140 may contain the interference nodule 140*c* that catches the ring engaging groove 150*d*, as shown in FIG. 1. The ring engaging groove 150*d* caught by the interference nodule 140*c* keeps the ring assembly 150 connected to the base unit 140 without slipping off. However, the ring assembly 150 can be easily slid back down and removed from the base unit 140 for cleaning. With the ring assembly 150 at the hem of the base unit rim 140*a*, the ring clamp 150*b* can securely fasten the lid assembly 112 to the base unit 140. The engaged ring clamp 150*b* applies pressure on lid 110, which in turn presses the sealing layer 120 down on the internal compartment rims 130*a* as well as the base unit rim 140*a*.

The sealing layer 120 is a flexible material, such as silicone, and may consist of rods 120*c*, hexagons or other shapes and vary in durometers for added strength and stability to this flexible sealing layer 120. When in contact with the base unit 140 while the ring clamp 150*b* is engaged, a seal cover 120*b* firmly presses down on the base unit rim 140*a*, removing entry and/or exit points for fluid to enter or escape. Furthermore, because the sealing layer 120 is a flexible layer with a particular range of stability and durometer, its seal cover 120*b* presses down over any internal compartment rims 130*a* (as depicted in FIG. 6), no matter the width, length, location or quantity that are included within the base unit 140. This pressure cuts off any possible exchange of food or fluid between internal compartments 130 to each other or the base unit 140.

Figure 7:
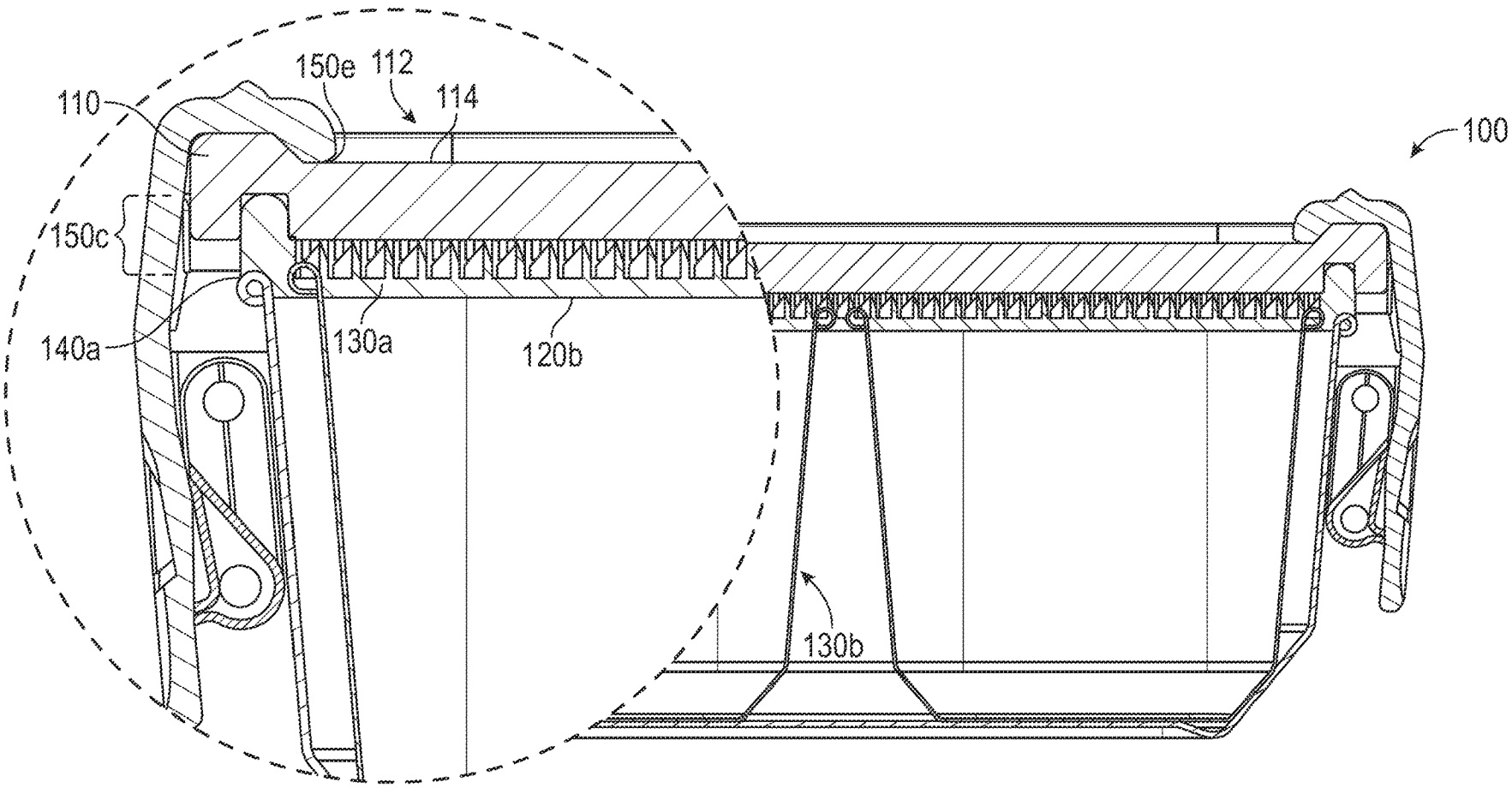
FIG. 7 is an enlarged cross-sectional view of the sealing layer in place over the internal compartments, with the lid and seal rendered slightly transparent for illustration purposes only in order to view the other parts behind and below them.

To further explain the leak-proof seal between internal compartments 130 and base unit 140, FIG. 7 shows an enlarged cross-sectional view of where the seal cover 120*b* meets the internal compartment rims 130*a* and the base unit rim 140*a*. The distance between where a top engagement section 150*e* of the engaged ring clamp 150*b* contacts a top 114 of the lid assembly 112 (or the top 114 of the engaged lid assembly 112) and the internal compartment rims 130*a* and/or the base unit rim 140*a* is slightly shorter than the height of the lid assembly 112, which allows for the seal cover 120*b* to exert a pushing force over and on the internal compartment rims 130*a* and base unit rim 140*a* when the ring clamp 150*b* is engaged, producing a leak-proof seal between internal compartments 130. The sealing function described provides a method of sealing internal compartments with a sealing layer, a method that does not require the internal compartments to have or use their own lids.

Referring to FIG. 5 and FIG. 6, when the ring assembly 150 is connected to the base unit 140, the ring 150*a* of the ring assembly 150 contains a top portion or lid guide 150*c* protrudes above any internal compartment rims 130*a* and/or the base unit rim 140*a*. The dimensions of the lid guide 150*c* allow the lid assembly 112 to fit directly over the hem of the base unit rim 140*a* to ensure proper location of the lid 110, and, thus, the seal cover 120*b* over the base unit 140 and any internal compartments 130 before the ring clamp 150*b* is engaged.

FIG. 6 illustrates a base bevel 140*b*, an additional location guide, that helps to keep any internal compartments positioned properly along the sides of the base unit 140. When and/or if an internal compartment 130 is positioned along the side walls within the base unit 140, the angled base bevel 140*b* comes into contact with the internal compartment bevel 130*b* making it slide to the floor of the base unit 140. This ensures the internal compartment 130 is positioned away from the side walls of base unit 140 so that the internal compartment rim 130*a* avoids contact with and/or overlapping of the base unit rim 140*a* allowing the sealing layer 2 to engage properly, as described above.

It should be known that the ring assembly 150 is the example depicted in these illustrations. However, other types of clamps or secure measures that exert a force between the lid and the base unit could be used in addition to or instead of the ring assembly 150 and have a similar effect.

In addition the sealing layer 120 being preferably made of silicone, the food container components are preferably made of stainless steel of varying gauges for a combination of strength and durability, yet still light enough in weight. The base unit 140, internal compartments 130 and lid 110 could be a single-walled stainless steel, but can also take a more insulated approach, such as having a dual-wall. In this scenario, air might be removed in between the walls and an insulating material and spacer support such as a cork layer may also exist.

While the likely materials of the food container 110 are stainless steel, it should be known that certain plastics, wood, silicone, or other materials may be used to provide a similar resulting product. However, from a current health and food safety standpoint, the food container 100 is intended to also function in a way that ensures no plastic resin touches food contents within the base unit 140 or internal compartments 130. Therefore, for the purposes of this description, the base unit 140 and the internal compartments 130 are made of a food-grade stainless steel.

Accordingly, it is important to note that the sealing layer 120 is not only a leak-proof layer, but also acts as a protection layer from food touching the lid 110. Therefore, the lid 110 may be of plastic material which can be used to provide color, patterns or even transparency to the food container 100. The lid 110 may also be formed from other materials such as wood, offering an additional function as a cutting board, serving tray or plate. Alternatively, similar to the internal compartments 130, the lid 110 may be formed from stainless steel. Stainless steel components might be powder-coated to provide exterior colors or patterns as well as an additional gripping benefit and durability. Likewise, the ring assembly 150 can offer a number of ways for color, patterns and other forms of personalization.

Figure 9:
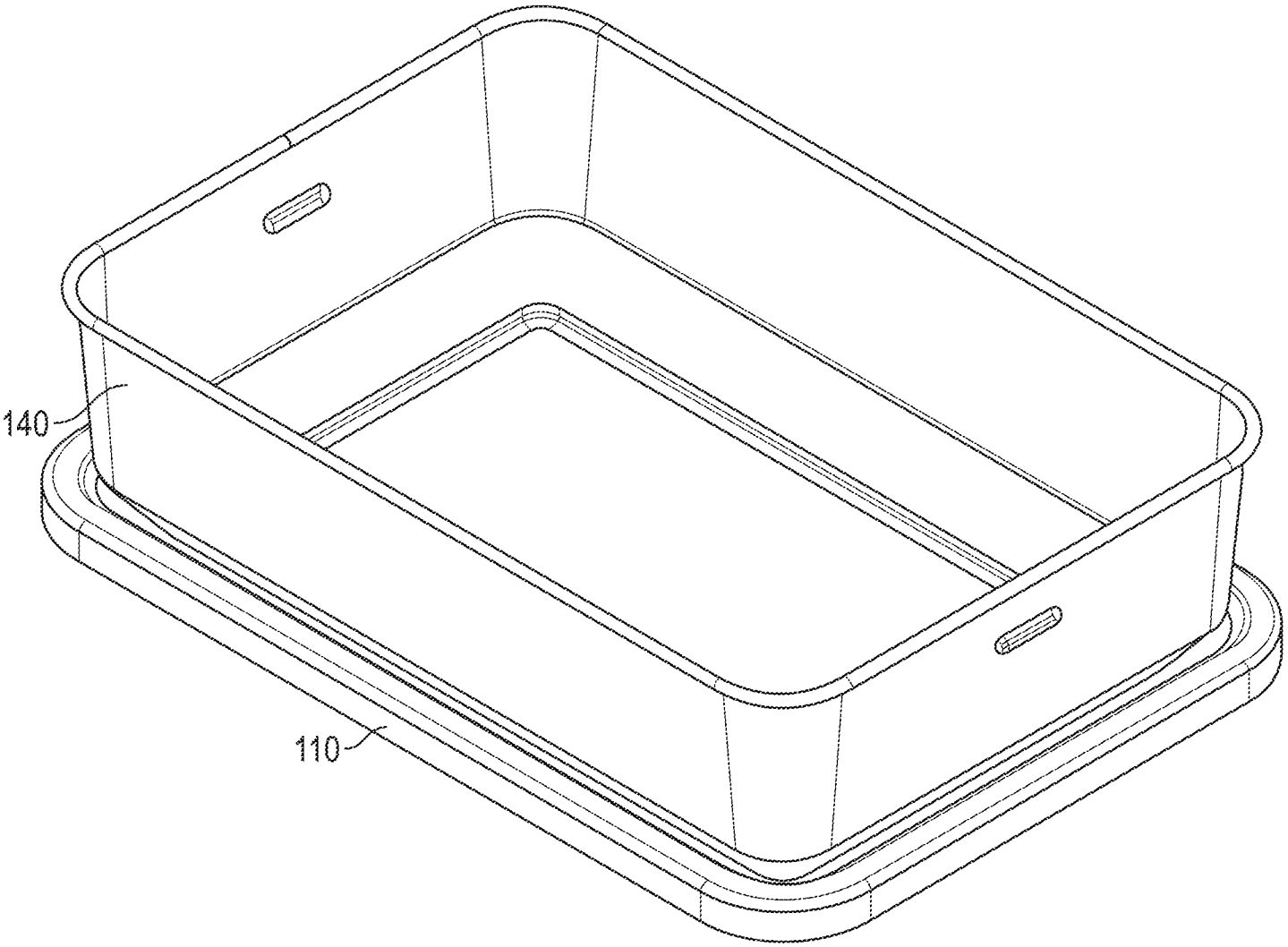
FIG. 9 is a perspective view showing how the container can rest on the lid.
Figure 10:
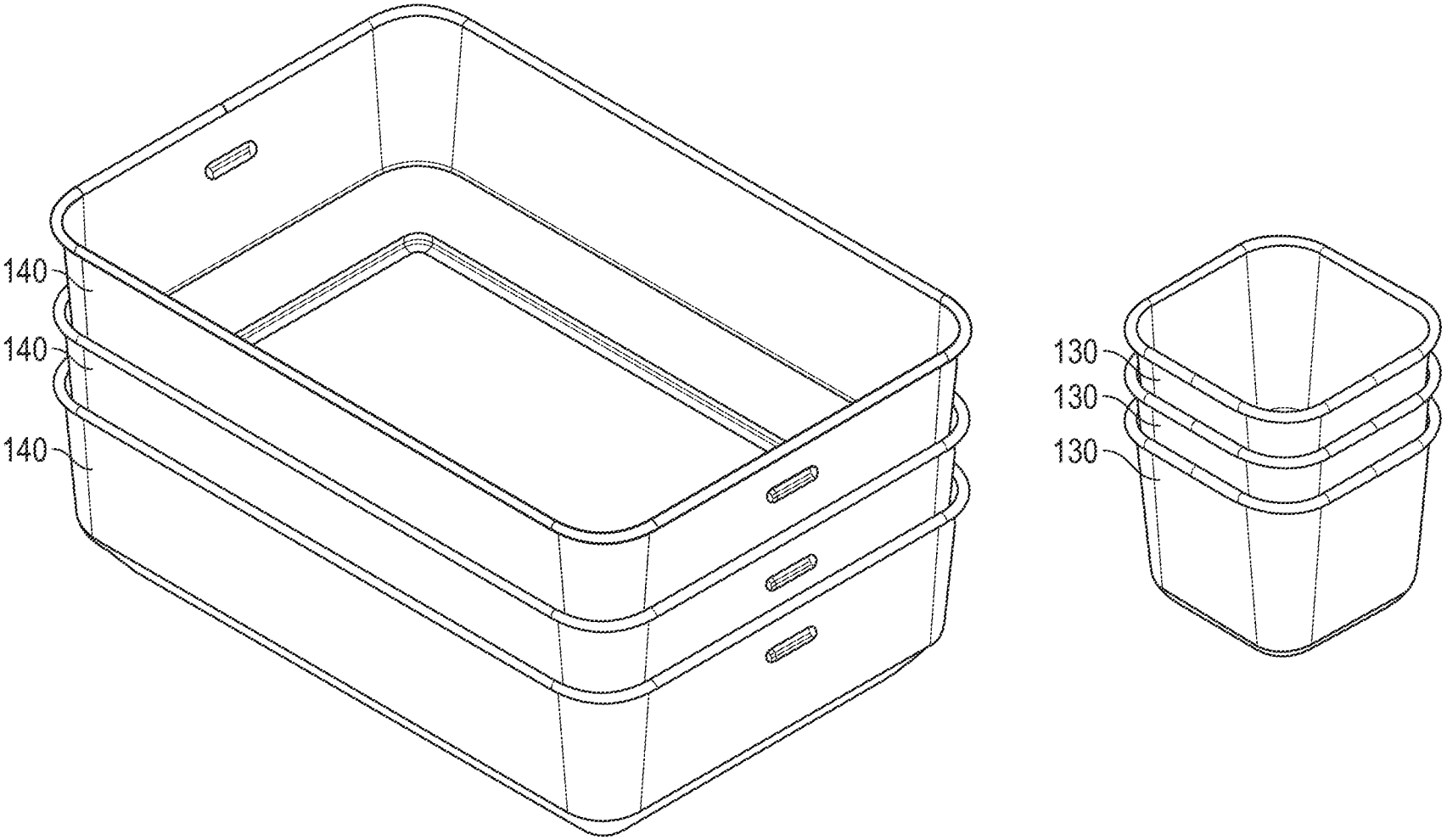
FIG. 10 is a perspective view showing how containers can nest within each other.
Figure 11:
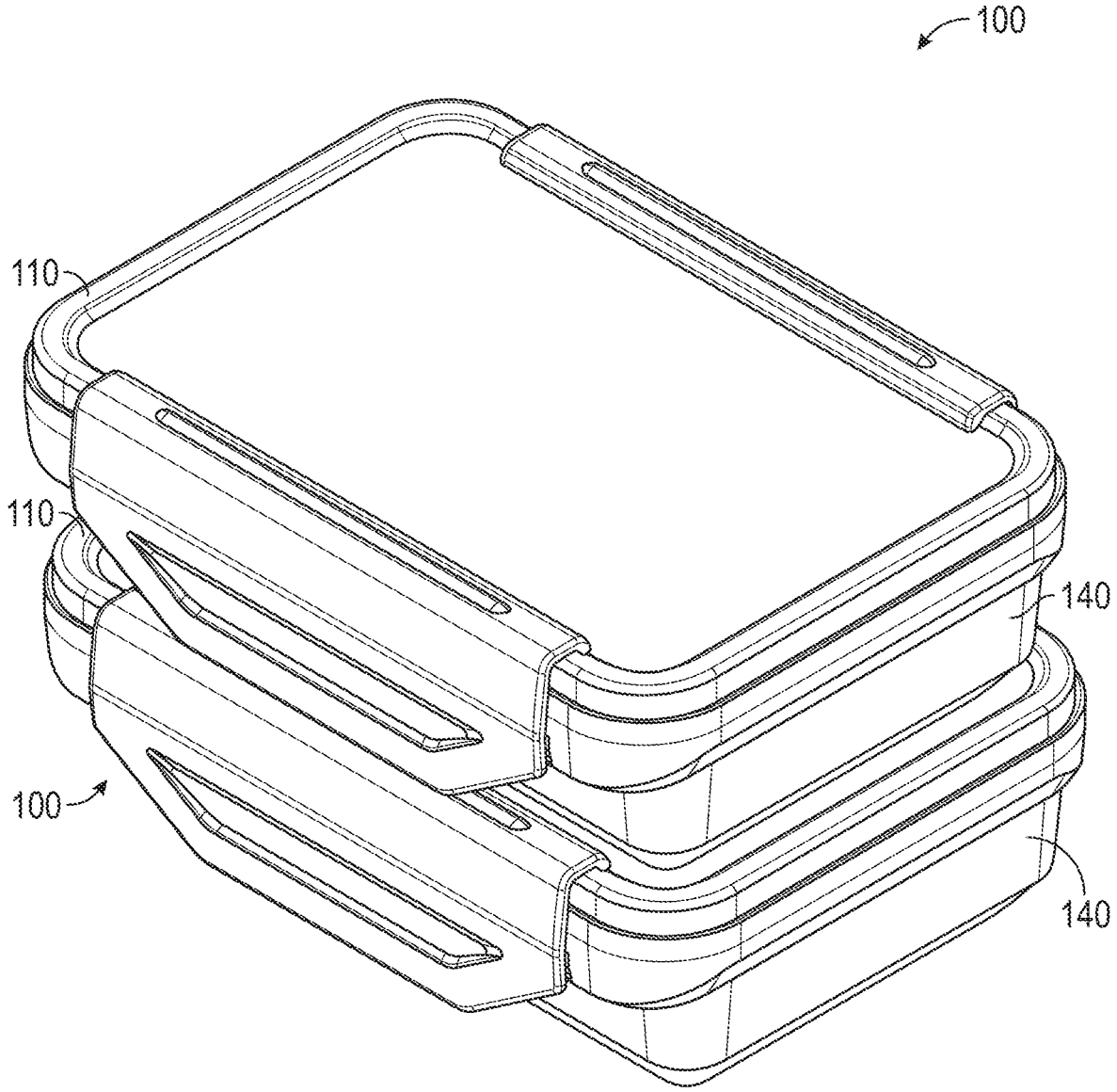
FIG. 11 is another perspective view showing how the assembled containers can stack on top of each other.

The lid 110 also has space-saving functions. Referring to FIG. 9, the base unit 140 can rest on the lid 110, providing a more secure base unit 140 while eating, and also takes up less space. FIG. 10 shows how the base units 140 and internal compartments 130 have wider rims than their bottoms so they can nest within themselves when storing away/not in use. Further, FIG. 11 illustrates how a base unit 140 of the food container 100 can stack on top of the lid 110 of another food container 100 with the lid 110 intact.

Because of the leak-proof function of sealing layer 120, the internal compartments 130 do not use their own lid when sealed in the base unit 140. However, for storing purposes, internal compartments 130 may use their own independent lid (not pictured in the figures) that can be put in place when storing in the refrigerator, freezer, pantry or other times when in use without the base unit 140.

The hem of the base unit rim 140*a* was described earlier to provide a stopping point for the ring assembly 150. With the removal of the ring assembly 150, the hem of the base unit rim 140*a* can also be a stopping point for a utility ring (not shown in figures) that might offer a number of different accessories: handles, carabiner, or other clips and clamps. These accessories might be part of the utility ring or pieces that clip or fasten to the utility ring. As an example, the addition of handles turns the base unit 140 into an easy to hold and transfer piece of cook ware.

The above figures may depict exemplary configurations for the invention, which is done to aid in understanding the features and functionality that can be included in the invention. The invention is not restricted to the illustrated architectures or configurations but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus, the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof;

and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. A food container, comprising:

a base unit including an open top and a base unit rim defining a periphery of the open top;

one or more removable internal compartments disposed within the base unit, the one or more removable compartments each including an internal compartment rim;

a sealing layer covering the open top and engaging the base unit rim and the internal compartment rim of the one or more removable internal compartments so as to form a leak-proof seal between the base unit rim and the internal compartment rim of the one or more removable internal compartments, wherein the base unit includes side walls with an angled base bevel along a bottom of the base unit, and the one or more removable internal compartments includes an internal compartment bevel, such that when the one or more removable internal compartments are disposed in the base unit, the one or more removable internal compartments are positioned away from the side walls of the base unit so that the leak-proof seal is formed between the base unit rim and the internal compartment rim of the one or more removable internal compartments.

2. The food container of claim 1, wherein the base unit and the internal compartments are made of a food-grade material.

3. The food container of claim 1, wherein the base unit is configured to be nestable within another base unit and the one or more removable internal compartments include multiple removable internal compartments configured to be nestable within each other.

4. The food container of claim 1, wherein the food container includes a lid assembly including a lid and the sealing layer, and the base unit and the lid are configured so that the base unit can rest on the lid, providing a more secure base unit while eating, while also taking up less space, and allowing the food container to stack on top of another food container with the lid intact.

5. The food container of claim 1, wherein the food container includes a lid that goes over the sealing layer and covers the open top of the base unit.

6. The food container of claim 5, wherein the sealing layer and the lid together form a lid assembly.

7. The food container of claim 6, wherein the sealing layer is directly removably attachable to the lid, the lid includes an underside with an engaging groove and the sealing layer includes a lip that is removably insertable within the engaging groove to removably attach the sealing layer to the lid, and when the lip is inserted into the engaging groove, the sealing layer directly contacts the underside of the lid and spans a distance within the engaging groove.

8. The food container of claim 7, wherein the lid extends over and laterally outward from the base unit rim.

9. The food container of claim 7, wherein the sealing layer covers the base unit rim, under the lip.

10. The food container of claim 1, wherein the sealing layer is flexible and includes one or more features to add strength and stability to the sealing layer.

11. The food container of claim 10, wherein the one or more features to add strength and stability to the sealing layer include one or more of rod-shaped features that span a distance within the base unit rim.

* * * * *